US006537391B2

(12) United States Patent
Ishige et al.

(10) Patent No.: US 6,537,391 B2
(45) Date of Patent: Mar. 25, 2003

(54) STEEL WITH IMPROVED IMPACT PENETRATION RESISTANCE AND METHOD FOR PRODUCING THE SAME

(75) Inventors: Kengo Ishige, Kodaira (JP); Tadashi Shibue, Yokohama (JP); Tsutomu Kakinouchi, Yokohama (JP); Fumimaru Kawabata, Chiyoda-ku (JP); Osamu Tanigawa, Chiyoda-ku (JP); Kiyoshi Uchida, Chiyoda-ku (JP); Junichi Kudou, Chiyoda-ku (JP)

(73) Assignees: Ishikawajima-Harima Jukogyo Kabushiki Kaisha, Tokyo (JP); Kawasaki Steel Corporation, Kobe (JP)

( * ) Notice: Subject to any disclaimer, the term of this patent is extended or adjusted under 35 U.S.C. 154(b) by 0 days.

(21) Appl. No.: 09/878,409

(22) Filed: Jun. 12, 2001

(65) Prior Publication Data

US 2003/0010414 A1 Jan. 16, 2003

(51) Int. Cl.[7] ..... C23C 38/00
(52) U.S. Cl. ..... 148/320; 148/662
(58) Field of Search ..... 148/320, 662

(56) References Cited

FOREIGN PATENT DOCUMENTS

JP 04099817 A2 * 8/1990

* cited by examiner

*Primary Examiner*—Roy King
*Assistant Examiner*—Andrew Wessman
(74) *Attorney, Agent, or Firm*—Oblon, Spivak, McClelland, Maier & Neustadt, P.C.

(57) ABSTRACT

A steel has a tensile strength of 850 to 1700 MPa, a yield ratio of at most 80%, and a penetration border energy ratio of at least 2.0 relative to the penetration border energy of a reference steel JIS SS400 (corresponding to ASTM A36) of the same thickness. The steel can be produced by first effecting a heat treatment 1 on an unstable austenitic steel; then effecting, at least once, one or more or any combination of the heat treatment 1 and a heat treatment 2 on the steel; and then finally effecting the heat treatment 2 on the steel. Heat treatment 1 heats the unstable austenitic steel to at least the Ac3 transformation temperature and then water-cools the steel to a temperature below 350° C. Heat treatment 2 heats the steel to a temperature between Ac3 and Ac1 transformation temperatures and then water-cools the steel to a temperature below 350° C.

16 Claims, 1 Drawing Sheet

STEEL WITH IMPROVED IMPACT PENETRATION RESISTANCE AND METHOD FOR PRODUCING THE SAME

BACKGROUND OF THE INVENTION

1. Field of the Invention

The present invention relates to steel with improved impact penetration resistance and to a method for producing the steel. In particular, the present invention relates to a steel with improved impact penetration resistance, weldability and bendability.

2. Discussion of the Background

Steel plate is required in certain applications to exhibit impact penetration resistance to projectiles such as shell splinters, bullets or space debris. To achieve impact penetration resistance, it is common to modify the chemical composition of the steel plate and to perform a heat treatment such as aging on the steel plate to increase its strength.

To produce a member having impact penetration resistance, it is conventional to cast an ingot and to form the ingot into a slab. The slab is then hot rolled to a required thickness and cooled. Then the slab is cut into pieces small enough for batch heat treatment, is processed for bending as required, and is subjected to a batch heat treatment such as aging to form a steel plate product having impact penetration resistance.

When large members are to be produced, smaller members are welded together after having been bent as required and subjected to batch heat treatment such as aging.

The tensile strength of conventional high-tensile or maraging steel plates designed for impact penetration resistance is suppressed to no more than 1200 MPa to avoid defects leading to delayed fracture of the plates in practical use.

However, these conventional steel plates have a problem in that the impact penetration resistance of the plates is inadequate. In particular, the steel plates have a penetration border energy ratio (as defined below) of only 1.5 relative to JIS SS400 (JISG3101 (1995)) plain carbon steel serving as a reference steel. JIS SS400 (JISG3101 (1995)) steel has a tensile strength of 400–510 MPa ($N/mm^2$) and corresponds to ASTM A36.

An additional problem with these conventional steel plates is that, since the plates require batch heat treatment, their allowable maximum size must be smaller than the dimensions of heat treatment furnaces.

Another problem with these conventional steel plates is that when steel plates that have been subjected to heat treatments such as ageing are welded together, preheating is required to prevent the formation of cold cracks. If the steel plates are welded together without preheating, then expensive austenitic welding materials are needed, resulting in an increase of cost.

Yet another problem with these conventional steel plates is that after having been subjected to heat treatment such as aging, the steel plates have poor bending properties and require a large bend radius (4 t) equal to four times the thickness t. To avoid this problem, the plates must be bent before being subjected to a heat treatment such as aging, which restricts flexibility in processing.

In view of the above, an object of the present invention is to improve the impact penetration resistance, and weldability and bendability, of steel.

SUMMARY OF THE INVENTION

In order to solve the aforementioned problems, the present inventors have conducted impact penetration tests with projectiles on a wide variety of steel from soft steel to high-strength steel, using a compact impact test apparatus for evaluating impact penetration resistance. However, the tests revealed the impossibility of improving impact penetration resistance only by increasing tensile strength.

The inventors then researched the influence of deformation, hardness distribution and microstructure of materials on impact penetration resistance, and introduced a new concept of penetration border energy. As a result of penetration tests measuring the penetration border energy of various materials, the inventors found that the penetration border energy of steel is enhanced if the tensile strength of the steel is in a certain range above a certain value and the yield ratio is lowered. Thus, the invention was completed successfully.

The term "yield ratio" as used herein refers to the ratio of yield strength to tensile strength (i.e. yield strength/tensile strength).

The term "penetration border energy" as used herein refers to the kinetic energy of a projectile traveling at the maximum speed at which the projectile will fail to penetrate a steel sample.

The invention was made to solve the aforementioned problems associated in the prior art.

A first aspect of the invention provides a steel with improved impact penetration resistance that has a tensile strength of 850 to 1700 MPa, a yield ratio of at most 80%, and a penetration border energy ratio of at least 2.0 relative to a JIS SS400 reference steel of the same thickness. This steel can have improved impact penetration resistance, weldability and bendability, because aging and similar heat treatments are not needed.

The term "penetration border energy ratio" as used herein refers to the ratio of the penetration border energy of a steel sample to the penetration border energy of a JIS SS400 reference steel sample, where the two penetration border energies are determined in penetration tests conducted under identical conditions. In particular, the penetration tests are conducted with a steel sample and a JIS SS400 reference steel sample having the same thickness. The penetration border energy ratio is used instead of the penetration border energy to draw general conclusions regarding impact penetration resistance, because absolute values of penetration border energy depend upon penetration test variables such as the shape and hardness of the projectile.

A second aspect of the invention provides a steel with improved impact penetration resistance that, in addition to the features of the steel of the first aspect of the invention, has at most 0.15% by weight of C and a weld crack sensitivity $P_{cm}$ of at most 0.27, where $P_{cm}$=C+Mn/20+Si/30+Ni/60+Cr/20+Mo/15+V/10+Cu/20+5B (% by weight, respectively).

A third aspect of the invention provides a method for producing steel with improved impact penetration resistance from unstable austenitic steel. The term "unstable austenitic steel" as used herein refers to a steel in which austenite is not the predominant phase at room temperature. The method according to the third aspect of the invention includes the steps of first effecting a heat treatment 1 on a steel; then effecting, at least once, one or more or any combination of the heat treatment 1 and a heat treatment 2 on the steel; and then finally effecting the heat treatment 2 on the steel. The heat treatment 1 includes heating the unstable austenitic steel to at least the Ac3 transformation temperature and then water-cooling the steel to a temperature below 350° C. The heat treatment 2 includes heating the steel to a temperature between the Ac3 and Ac1 transformation temperatures and than water-cooling the steel to a temperature below 350° C. The Ac1 transformation temperature is the temperature at which austenite begins to form during heating, and the Ac3 transformation temperature is the temperature at which transformation of ferrite to austenite is completed during heating.

According to the third aspect of the invention, steel with improved impact penetration resistance can be produced, even from unstable austenitic steel, that has a tensile strength of 850 to 1700 MPa, a yield ratio of at most 80%, and a penetration border energy ratio of at least 2.0. The microstructure of the steel after the final heat treatment 2 includes bainite, martensite and island-shaped martensite in combination.

Embodiments of steel with improved impact penetration resistance according to the invention will now be described in greater detail.

DETAILED DESCRIPTION OF THE PREFERRED EMBODIMENTS

Figure 1:
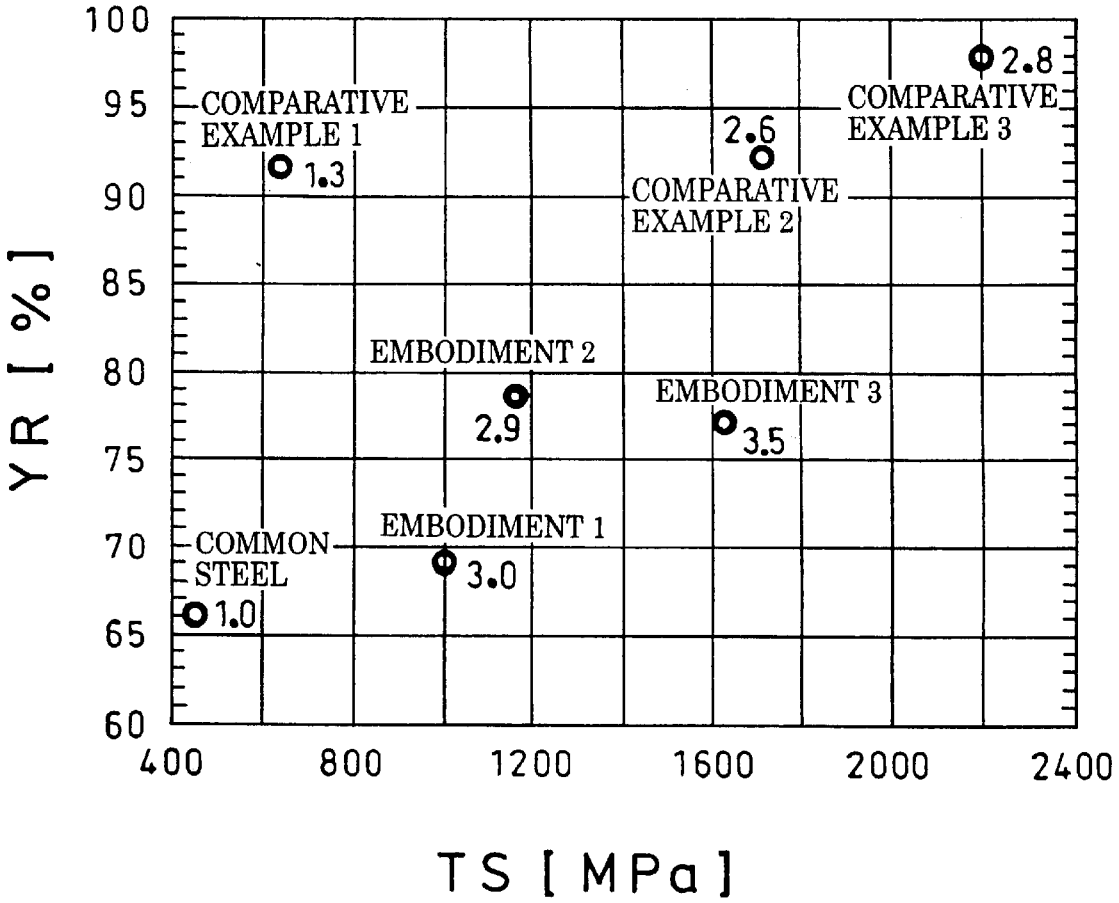
FIG. 1 is a graph contrasting tensile strength, yield ratio, and penetration border energy ratio characteristics of inventive embodiments of steel having improved impact penetration resistance, a reference steel, and comparative examples.

Steel with improved impact penetration resistance according to the present invention has a tensile strength of 850 to 1700 MPa, a yield ratio of at most 80%, and a penetration border energy ratio of at least 2.0.

The discovery of this steel resulted from projectile penetration tests using a wide variety of conventional steels from soft steel (having a tensile strength of the order of 400 MPa) to high-strength steel (maraging steel having a tensile strength of the order of 2000 MPa), using a compact impact test apparatus for evaluating impact penetration resistance.

The tests showed the impossibility of improving the impact penetration resistance of these conventional steels by only increasing tensile strength ("TS").

The tested materials were examined for deformation, hardness distribution, microstructure and the like, and a new concept of penetration border energy was introduced. This was measured in the penetration tests to study in detail the material requirements for obtaining impact penetration resistance. It was found that the penetration border energy may be enhanced if the tensile strength is in a certain range above a given value and the yield ratio ("YR") is below a given point.

The projectile penetration tests for evaluating impact penetration resistance were conducted using a compact impact test apparatus on many samples with the speed of the projectile being employed as the parameter. In the tests, the energy at the maximum speed of the projectile at which no penetration occurs was determined as the penetration border energy. Typical values of the energy are shown in Table 1 and FIG. 1.

TABLE 1

| | Tensile Strength (TS) (MPa) | Yield Ratio (YR) (%) | Penetration Border Energy Ratio |
|---|---|---|---|
| Embodiment 1 | 1004 | 69.3 | 3.0 |
| Embodiment 2 | 1170 | 78.0 | 2.9 |
| Embodiment 3 | 1620 | 77.0 | 3.5 |
| Plain Carbon Steel | 405 | 66.0 | 1.0 |
| Comparative Example 1 | 634 | 91.6 | 1.3 |

TABLE 1-continued

| | Tensile Strength (TS) (MPa) | Yield Ratio (YR) (%) | Penetration Border Energy Ratio |
|---|---|---|---|
| Comparative Example 2 | 1717 | 92.1 | 2.6 |
| Comparative Example 3 | 2205 | 97.8 | 2.8 |

Table 1 shows the penetration border energy ratios of four types of steel: the reference steel JIS SS400 (plain carbon steel having a tensile strength of the order of 400 MPa), comparative steels 1 to 3 (high-strength steels and maraging steel having a tensile strength of the order of 600 to 2000 MPa), and embodiments according to this invention.

The upper limit of tensile strength TS in the steel having improved impact penetration resistance according to the invention is set at 1700 MPa because suppression of the yield ratio YR to at most 80% is hard to obtain from manufacturing restrictions if the tensile strength is over 1700 MPa. In addition, if the tensile strength is over 1700 MPa, delayed fracture may occur depending upon service conditions. The lower limit of tensile strength TS is set at 850 MPa because sufficient impact penetration resistance cannot be obtained when a tensile strength is below 850 MPa.

The upper limit of the yield ratio YR is 80%, because when YR is above 80%, the penetration border energy becomes reduced. The lower limit of the yield ratio YR is not defined to a particular value, but from the manufacturing point of view it has an inherent lower limit of 60% or so.

The lower limit of the penetration border energy ratio is 2.0, because steel with a penetration border energy ratio below 2.0 is not significantly superior in impact penetration resistance to conventional steels.

To quantify impact penetration resistance, penetration border energy ratios must be used instead of penetration border energies. This is because the penetration border energy of a sample may have a different absolute value depending upon the experimental conditions used. Thus, the penetration border energies of different samples may not be used for generalized comparisons.

In achieving the present invention, the experimentally obtained penetration border energy of the aforementioned steel JIS SS400 was regarded as a reference. The penetration border energies of the steels of comparative examples 1 to 3 and embodiments 1 to 3 of the invention, all of which were determined under the same conditions as the penetration border energy of JIS SS400, were normalized with respect to the penetration border energy of the reference steel JIS SS400 to obtain penetration border energy ratios. These penetration border energy ratios, obtained under identical experimental conditions and having a common reference, provide an accurate comparison of the impact penetration resistance of different materials.

In the penetration test, a projectile having mass m of about 13 g and made of SNCM439 (JIS G4103; nickel-chromium-molybdenum steel corresponding to AISI 4340, SAE 4340), and samples of 7 mm thickness were employed.

Letting v be the penetration border speed of the projectile, the penetration border energy E associated with a sample is determined by the following equation:

$$E=\tfrac{1}{2}\cdot m\cdot v^2 \quad (1).$$

The term "penetration border speed" as used herein refers to the maximum speed of a projectile at which the projectile will fail to penetrate a steel sample.

Thus, the penetration border energy ratio is expressed:

$$\text{Penetration border energy ratio}=E/E_{JIS\ SS400} \quad (2),$$

where $E_{JIS\ SS400}$ is the penetration border energy of a reference JIS SS400 steel sample.

Improved weldability and bendability can be obtained in a steel with improved impact penetration resistance according to the invention if the steel has at most 0. 15% by weight of C and has a weld crack sensitivity $P_{cm}$ of at most 0.27.

The upper limit for the carbon content is 0.15% by weight, because excess carbon can lead to weld cracks in welded steel that substantially lower impact penetration resistance. In addition, the increase in hardenability resulting from the excess carbon might deteriorate the effect of heat treatment 1 (to excessively increase the strength) and the effect of heat treatment 2 (to reduce the two-phase-region temperature range).

The upper limit for $P_{cm}$ is 0.27 to avoid the problems relating to weld cracks and increased hardenability associated with excess carbon mentioned above. These problems are also associated with excessive amounts of alloy elements such as Mn, Si, Ni, Cr, Mo, V, Cu and B.

Such steel can have a penetration border energy ratio of at least 2.0, and higher impact penetration resistance than conventional steels.

A method for producing the steel with improved impact penetration resistance according to the invention includes applying a combination of a heat treatment 1 and a heat treatment 2 to unstable austenitic steel. The steel produced by the method exhibits improved impact penetration resistance and has a tensile strength of 850 to 1700 MPa, a yield ratio of at most 80%, and a penetration border energy ratio of at least 2.0.

In heat treatment 1, unstable austenitic steel is heated to at least the Ac3 transformation temperature and then to water-cool the steel to a temperature below 350° C. Heat treatment 2 is to heat the steel to a temperature between the Ac3 and Ac1 transformation temperatures and then to water-cool the steel to a temperature below 350° C. Heat treatment 1 is performed first, then heat treatment 1 or 2 or combination thereof is performed at least once, and finally heat treatment 2 is performed to complete the entire heat treatment process.

First, the steel requires a heat treatment for stabilized and sufficient hardenability so as to obtain high strength. Therefore, heat treatment 1 is performed, as the first heat treatment, to heat the steel to at least the Ac3 transformation temperature, thereby minimizing the generation of non-transformed austenite that has detrimental effects on the increase in strength of the steel.

After the first heat treatment 1, the hardenability of the steel is not significantly deteriorated by performing heat treatment 2, which intentionally allows the non-transformed austenite to remain. In heat treatment 2, the steel is heated to a temperature between the Ac3 and Ac1 transformation temperatures and then is water-cooled to a temperature below 350° C. Thus, with the increased strength being retained, hardened microstructure such as the martensite structure may be dispersed to lower the yield ratio.

Alternatively, for homogenization and fine granulation of the structure, a combination of the heat treatments 1 and 2 may be repeated several times after the first heat treatment 1 without deteriorating the effects of the heat treatment 1. However, the last heat treatment must be heat treatment 2 since the two-phase hardening (heat treatment 2) will make it possible to partly re-transform fine martensite structure formed by heat treatment 1 to reduce needle-like martensite and disperse granular fine martensite. Microscopic yielding, which is a mechanism for lowering yield ratio, may be more uniformly occurred in structure in the case of the granular fine martensite than in needle-like martensite, which will further lower the yield ratio and will increase stability in deformation. In other words, two-phase hardening can provide a yield ratio suppressed to at most 80% and increase a work hardening index.

Another reason why the last heat treatment is heat treatment 2 is because heat treatment 1 cannot provide a yield ratio suppressed to at most 80% and a penetration border energy ratio increased to at least 2.0.

The Ac3 and Ac1 transformation temperatures that are necessary for producing such steel with improved impact penetration resistance may be actually measured from the thermal expansion curve; alternatively, they may be calculated by substituting the constituents (such as C, Si, and Mn) of the steel in percent by weight into the following equations (3) and (4):

$$T_{Ac3}=937-476.5\,C+56\,Si-19.7\,Mn-16.3\,Cu-26.6\,Ni-4.9\,Cr+38.1\,Mo+124.8\,V+136.3\,Ti+35\,Zr-19\,Nb+198Al+3315\,B \quad (3)$$

$$T_{Ac1}=751-26.6\,C+17.6\,Si-11.6\,Mn-22.9\,Cu-23.0\,Ni+24.1\,Cr+22.5\,Mo-39.7\,V-5.7\,Ti+31.9\,Zr+233\,Nb+169\,Al-895\,B \quad (4)$$

Thus, for example, heat treatment 1 is effected in which hot rolled steel is heated up to 890° C. (Ac3=879° C.) and then water-cooled to below 100° C. Then, heat treatment 2 is effected in which the steel is further heated up to 780° C. (Ac1=716° C.) and then water-cooled to below 100° C. It is thereby possible to produce a steel member having a required thickness in a conventional plate production line.

This makes it possible to produce a steel plate having a maximum size of approximately 2 m in width and approximately 12 m in length with no restriction on the size of the heat treatment furnace unlike the prior art using aging and batch heat treatment. This contributes to reduction of welding cost upon producing large-sized steel members.

EXAMPLES

Preferred embodiments of steel with improved impact penetration resistance according to the invention will be described. However, the invention is not limited to these embodiments.

As steel with improved impact penetration resistance according to the invention, a steel is produced with the following chemical composition (% by weight): 0.10% C, 0.14% Si, 0.84% Mn, 0.005% P, 0.0009% S, 0.24% Cu, 1.28% Ni, 0.50% Cr, 0.50% Mo, 0.03% V, 0.001% B, 0.066% Al, 0.50% $C_{eq.}$, and $P_{cm}$=0.25.

The steel is hot rolled, then is subjected to a primary quenching at 890° C. and thereafter a secondary quenching at 780° C. into a steel plate having 2 m in width, 12 m in length and 7 mm in thickness according to the invention (embodiment 1).

Measurement of major mechanical properties of the steel (embodiment 1) revealed the following:

| | |
|---|---|
| yield strength YS | 696 MPa |
| tensile strength T5 | 1004 MPa |
| elongation EL | 20% |
| yield ratio YR | 69% |
| vE-20 | 53 J |
| (JIS No. 4 specimen with thickness of 5 mm) | |

Thus, it was confirmed that the steel (embodiment 1) satisfied the tensile strength TS and yield ratio YR as well as the mechanical properties required of the steel according to the invention.

Furthermore, to evaluate the impact penetration resistance of the steel (embodiment 1), a penetration test was conducted under the same conditions as those for the reference steel JIS SS400. In the test, the maximum speed at which no penetration occurred was determined to obtain the penetration border energy, and then the penetration border energy ratio was calculated to be 3.0 from the above-mentioned equations (1) and (2). Thus, it was confirmed that the measured value for the present steel significantly exceeded the value required of the steel according to the invention and thus the present steel had improved impact penetration resistance. In the penetration test, the above-mentioned projectile having mass m of about 13 g and made of SNCM439 (JIS G4103: nickel-chromium-molybdenum steel, corresponding to AISI 4340, SAE 4340), and samples of 7 mm thickness were employed.

Furthermore, a bending test was conducted on the steel (embodiment 1) to find whether or not it was possible for a test piece having been subjected to the plasma cutting, which simulated an actual cutting, to be bent 180 degrees with an inner radius 1.5 times the thickness t, i.e., the inner radius of 1 .5 t. It was thus confirmed that the steel (embodiment 1) was provided with higher bendability than that of the conventional maraging steel having a recommended bending radius of 4 t.

In addition, as for the weldability of the steel (embodiment 1), the steel provides $P_{cm}$ (weld crack sensitivity) as low as 0.25 and can be welded at a thickness of about 7 mm without being preheated even with a welding material of similar composition. It was confirmed in a tensile test on a joint that the steel can ensure sufficient strength as well as guarantee sufficient impact penetration resistance to the jointed portion.

Furthermore, the steel (embodiment 1) is subjected to secondary quenching or rapid cooling from 780° C., to control the temperature of linear heating for bending work to a temperature range from the quenching temperature of 890° C. to a temperature of 750° C., slightly below the secondary quenching temperature, thereby making it possible to perform the linear heating while preventing change in its structure.

Now, the method for producing the steel with improved impact penetration resistance according to the invention will be described with reference to embodiments in conjunction with comparative examples.

Steel having the same chemical composition as that of embodiment 1 was employed to produce three types of steel according to embodiments 4 to 6 of the invention shown in Table 3 by combination of heat treatments 1 and 2 under the heating temperature and water cooling temperature conditions shown in Table 2. In addition, five types of steel according to comparative examples 4 to 8, which have different heat treatment conditions, were produced.

TABLE 2

| Heat Treatment No. | Heated temperature | Water-cooled temperature |
|---|---|---|
| Heat Treatment 1 | 890° C. | below 100° C. |
| Heat Treatment 2 | 780° C. | below 100° C. |

Ac3 transformation temperature: 879° C.
Ac1 transformation temperature: 716° C.

TABLE 3

| Sequence of Heat Treatments | | | |
|---|---|---|---|
| Embodiment 4 | Heat Treatment 1 | Heat Treatment 2 | |
| Embodiment 5 | Heat Treatment 1 | Heat Treatment 1 | Heat Treatment 2 |
| Embodiment 6 | Heat Treatment 1 | Heat Treatment 2 | Heat Treatment 2 |
| Comparative Example 4 | Heat Treatment 1 | | |

TABLE 3-continued

| Sequence of Heat Treatments | | | |
|---|---|---|---|
| Comparative Example 5 | Heat Treatment 2 | | |
| Comparative Example 6 | Heat Treatment 2 | Heat Treatment 2 | |
| Comparative Example 7 | Heat Treatment 2 | Heat Treatment 1 | |
| Comparative Example 8 | Heat Treatment 1 | Heat Treatment 2 | Heat Treatment 1 |

In order to study the mechanical properties and impact penetration resistance of the steel according to embodiments 4 to 6 and comparative examples 4 to 8, penetration tests were conducted under the same conditions as that for the aforementioned reference steel JIS SS400 to determine the maximum speed, v, at which no penetration occurred to obtain the penetration border energy, E, from the aforementioned equations (1) and (2. Then the penetration border energy ratio was calculated as shown in Table 4.

TABLE 4

| | Tensile Strength (TS) (MPa) | Yield Ratio (YR) (%) | Penetration Border Energy Ratio |
|---|---|---|---|
| Embodiment 4 | 1004 | 69.3 | 3.0 |
| Embodiment 5 | 1013 | 71.3 | 3.0 |
| Embodiment 6 | 982 | 66.8 | 3.0 |
| Comparative Example 4 | 1029 | 82.1 | 1.8 |
| Comparative Example 5 | 849 | 66.3 | 1.9 |
| Comparative Example 6 | 824 | 61.4 | 1.7 |
| Comparative Example 7 | 1031 | 81.1 | 1.5 |
| Comparative Example 8 | 1033 | 82.5 | 1.5 |

As can be seen clearly from Table 4, it was confirmed that the steel of embodiments 4 to 6 according to the production method of the invention could satisfy the tensile strength TS and yield ratio YR, which are required, of the steel according to the invention as well as having satisfactory mechanical properties.

It was also confirmed that the steels of embodiments 4 to 6 according to the production method of the invention exceeded significantly the penetration border energy ratio that is required of the steel according to the invention and were provided with improved impact penetration resistance.

In the aforementioned explanations and embodiments, JIS SS400 being a plain carbon steel was employed as a reference steel to explain penetration border energy ratios with respect to the reference steel, thereby offering an advantage for clearer understanding of the magnitude of the penetration border energy ratio. Nevertheless, it is quite possible to select a steel other than the aforementioned JIS SS400 as the reference steel to express penetration border energy ratios with respect to the penetration border energy of the reference steel.

As explained above specifically with reference to the embodiments, the steel with improved impact penetration resistance according to the invention has a tensile strength of 850 to 1700 MPa, a yield ratio of at most 80%, and a penetration border energy ratio of at least 2.0 with respect to the penetration border energy of the reference steel JIS SS400 with the same thickness. Thus, the steel makes it possible to provide improved impact penetration resistance as well as enhanced weldability and bendability.

Furthermore, the invention provides a method for producing steel with improved impact penetration resistance.

Even from unstable austenitic steel, steel with improved impact penetration resistance can be produced that has a tensile strength of 850 to 1700 MPa, a yield ratio of at most 80%, and a penetration border energy ratio of at least 2.0 relative the penetration border energy of a reference steel JIS SS400 of the same thickness.

What is claimed is:

1. A steel with improved impact penetration resistance, the steel comprising at most 0.15% by weight of C, wherein the steel has a tensile strength of 850 to 1700 MPa, a yield ratio of at most 80%, a penetration border energy ratio of at least 2.0, and a weld crack sensitivity $P_{cm}$ of at most 0.27 where, in % by weight, $P_{cm}$=C+(Mn/20)+(Si/30)+(Ni/60)+(Cr/20)+(Mo/15)+(V/10)+(Cu/20)+(5B); and the steel has a microstructure comprising island-shaped martensite.

2. The steel according to claim 1, wherein the tensile strength is from 982 to 1700 MPa.

3. The steel according to claim 2, wherein the tensile strength is from 982 to 1620 MPa.

4. The steel according to claim 1, wherein the microstructure further comprises bainite, tempered bainite, martensite, and tempered martensite.

5. The steel according to claim 2, wherein the microstructure further comprises bainite, tempered bainite, martensite, and tempered martensite.

6. The steel according to claim 3, wherein the microstructure further comprises bainite, tempered bainite, martensite, and tempered martensite.

7. The steel according to claim 1, wherein the microstructure consists of bainite, tempered bainite, martensite, island-shaped martensite, and tempered martensite.

8. The steel according to claim 2, wherein the microstructure consists of bainite, tempered bainite, martensite, island-shaped martensite, and tempered martensite.

9. The steel according to claim 3, wherein the microstructure consists of bainite, tempered bainite, martensite, island-shaped martensite, and tempered martensite.

10. The steel according to claim 1, wherein the steel comprises C, Mn, Si, Ni, Cr, Mo, V, Cu and B.

11. The steel according to claim 1, wherein the steel is produced from unstable austenitic steel by a process comprising first effecting a heat treatment 1, then effecting, at least once, one or more or any combination of the heat treatment 1 and a heat treatment 2, and then effecting the heat treatment 2 as a final heat treatment, where the heat treatment 1 comprises heating to at least the Ac3 transformation temperature and then water-cooling to a temperature below 350° C., and the heat treatment 2 comprises heating to a temperature between the Ac3 and Ac1 transformation temperatures and then water-cooling to a temperature below 350° C.

12. The steel according to claim 2, wherein the steel is produced from unstable austenitic steel by a process comprising first effecting a heat treatment 1, then effecting, at least once, one or more or any combination of the heat treatment 1 and a heat treatment 2, and then effecting the heat treatment 2 as a final heat treatment, where the heat treatment 1 comprises heating to at least the Ac3 transformation temperature and then water-cooling to a temperature below 350° C., and the heat treatment 2 comprises heating to a temperature between the Ac3 and Ac1 transformation temperatures and then water-cooling to a temperature below 350° C.

13. The steel according to claim 3, wherein the steel is produced from unstable austenitic steel by a process comprising first effecting a heat treatment 1, then effecting, at least once, one or more or any combination of the heat treatment 1 and a heat treatment 2, and then effecting the heat treatment 2 as a final heat treatment, where the heat treatment 1 comprises heating to at least the Ac3 transformation temperature and then water-cooling to a temperature below 350° C., and the heat treatment 2 comprises heating to a temperature between the Ac3 and Ac1 transformation temperatures and then water-cooling to a temperature below 350° C.

14. A steel structure comprising the steel of claim 1.

15. A method for producing the steel of claim 1 with improved impact penetration resistance from unstable austenitic steel, the method comprising first effecting a heat treatment 1 on a steel;

then effecting, at least once, one or more or any combination of the heat treatment 1 and a heat treatment 2 on the steel; and then effecting the heat treatment 2 on the steel; wherein and the heat treatment 1 comprises heating the steel of claim 1 to at least the Ac3 transformation temperature of the steel and then water-cooling the steel to a temperature below 350° C.; and the heat treatment 2 comprises heating the steel to a temperature between the Ac3 and Ac1 transformation temperatures of the steel and then water-cooling the steel to a temperature below 350° C.

16. A method for producing steel with improved impact penetration resistance from unstable austenitic steel, the method comprising first effecting a heat treatment 1 on a steel; and then effecting a heat treatment 2 on the steel; wherein the heat treatment 1 comprises heating the steel to at least the Ac3 transformation temperature of the steel and then water-cooling the steel to a temperature below 350° C.; and the heat treatment 2 comprises heating the steel to a temperature between the Ac3 and Ac1 transformation temperatures of the steel and then water-cooling the steel to a temperature below 350° C.

* * * * *

UNITED STATES PATENT AND TRADEMARK OFFICE

CERTIFICATE OF CORRECTION

PATENT NO. : 6,537,391 B2
DATED : March 25, 2003
INVENTOR(S) : Kengo Ishige et al.

It is certified that error appears in the above-identified patent and that said Letters Patent is hereby corrected as shown below:

Column 10,
Line 38, “and” should be deleted.
Line 39, “of” should be deleted.
Line 40, “claim 1” should be deleted.
Line 47, “steel” should read -- the steel of claim 1 --.

Signed and Sealed this

Twenty-seventh Day of January, 2004

JON W. DUDAS
*Acting Director of the United States Patent and Trademark Office*